United States Patent [19]

Wolski

[11] 4,051,340

[45] Sept. 27, 1977

[54] OVERLOAD RELAY RESET ASSEMBLY

[75] Inventor: Jerome C. Wolski, Downers Grove, Ill.

[73] Assignee: Westinghouse Electric Corporation, Pittsburgh, Pa.

[21] Appl. No.: 717,964

[22] Filed: Aug. 26, 1976

[51] Int. Cl.[2] ..... H01H 3/00

[52] U.S. Cl. ..... 200/329; 200/50 A; 200/330; 200/337; 200/340

[58] Field of Search ..... 200/329, 330, 340, 337, 200/50 A, 333, 332; 337/48

[56] References Cited

U.S. PATENT DOCUMENTS

| | | | |
|---|---|---|---|
| 2,937,535 | 5/1960 | Wezner | 200/300 |
| 3,099,736 | 7/1963 | Willcox | 200/330 |
| 4,011,423 | 3/1977 | Zepp | 200/50 A |

*Primary Examiner*—E. A. Goldberg
*Attorney, Agent, or Firm*—L. P. Johns

[57] ABSTRACT

A reset assembly for an overload relay adapted to function in conjunction with a contactor for controlling an electric load such as a three-phase motor. The overload reset assembly is characterized by a reset rod and an extension rod detachably mounted on the reset rod which rods comprise detachable interlocking means for assembly and disassembly whereby the extension rod extends from the reset rod to the access door of a metal enclosure containing the overload relay.

11 Claims, 9 Drawing Figures

10

FIG. 3
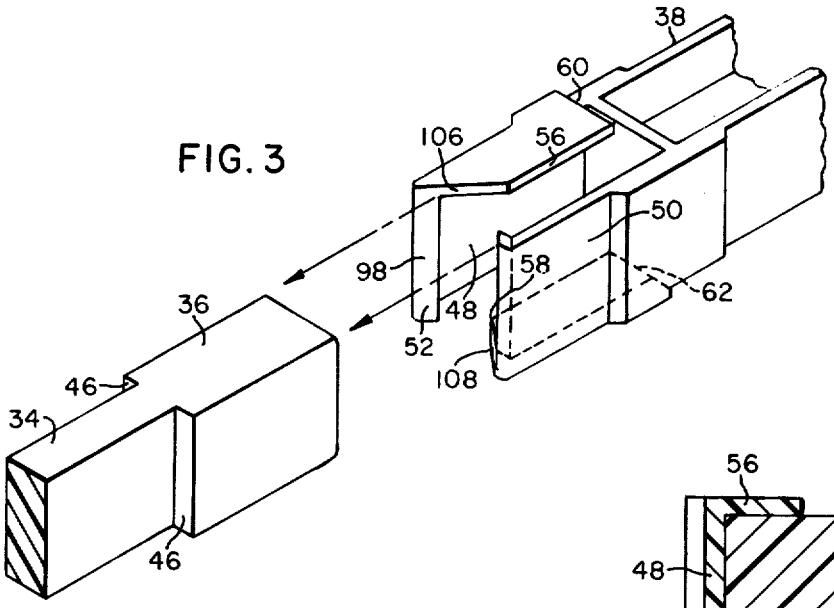
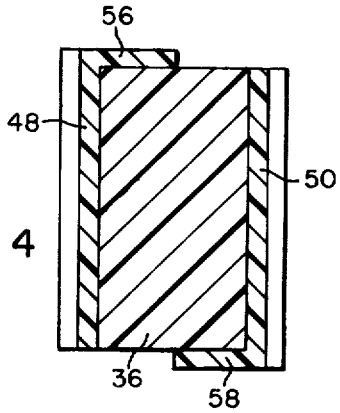
FIG. 4
FIG. 5
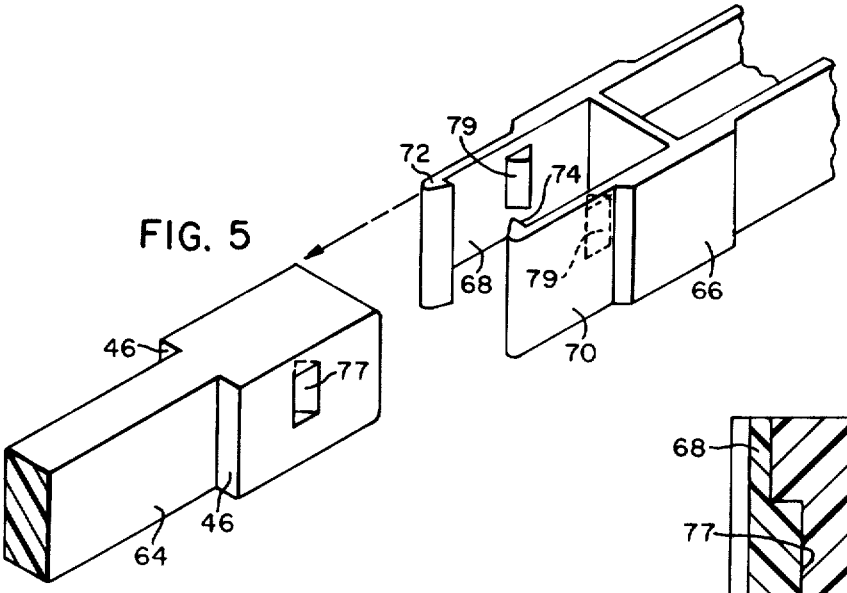
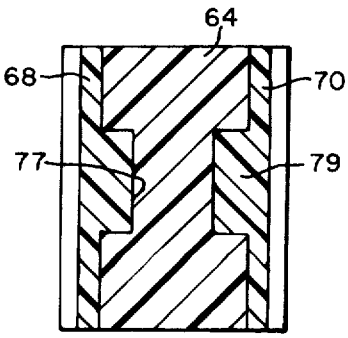
FIG. 6

OVERLOAD RELAY RESET ASSEMBLY

BACKGROUND OF THE INVENTION

1. Field of the Invention

This invention relates to overload relay reset means, and more particularly to an extension rod for a reset rod of the relay.

2. Description of the Prior Art

In motor control center apparatus a motor starter is usually mounted on a panel or rear wall that is spaced from an access door. Such a starter comprises a contactor and an overload relay which are spaced from the access door. Formerly, to reset an overload relay after a trip operation, it was necessary to open the door and manually actuate a reset rod in the relay. Subsequently, a reset mechanism including a reset button mounted in the door and an extension rod between the button and the reset rod were provided. However, when the door was opened, the extension rod which projected from the door frequently was broken off inadvertently when the door was opened.

SUMMARY OF THE INVENTION

In accordance with this invention, it has been found that the foregoing problem may be overcome by providing an electric control device comprising an enclosure including a rear wall, a front opening and an access door for the front opening and having an aperture therein; a circuit interrupter structure mounted on the rear wall and spaced from the access door, the structure comprising relatively movable contact means, means releasable to effect automatic opening of said contact means, the releasable means including a releasable arm movable between latched and unlatched positions, a trip device operable to effect unlatching of the releasable arm, reset means operatively connected to the releasable arm for moving the arm to the latch position and comprising a reset rod having an end portion spaced from the access door, an extension rod extending between the reset rod and a reset button in the aperture, the extension rod and the reset rod comprising releasable interengaging portions including on one of the rods a pair of flexible members grasping the end portion of the other rod, the flexible members being disposed on opposite sides of the end portion, the end portion having at least one shoulder surface, the flexible members comprising jaw means for engaging the shoulder surface, and the flexible members and the end portion comprising cooperating surfaces extending laterally of the shoulder surface to avoid lateral movement of the extension rod from the reset rod.

The advantage of the device of this invention is that the extension rod can be easily attached or detached without breaking the extension rod or the recess rod. If the extension rod is inadvertently bumped from the reset rod, there is normally no damage to either rod and reattachment of the extension rod to the reset rod may be made without delay.

BRIEF DESCRIPTION OF THE DRAWINGS

FIGS. 3, 5, and 7 are exploded isometric views of different embodiments of the reset rod and the extension rod.

FIGS. 4 and 6 are sectional views through the embodiments of FIGS. 3 and 5, respectively, in the assembled positions.

DESCRIPTION OF THE PREFERRED EMBODIMENTS

Figure 1:
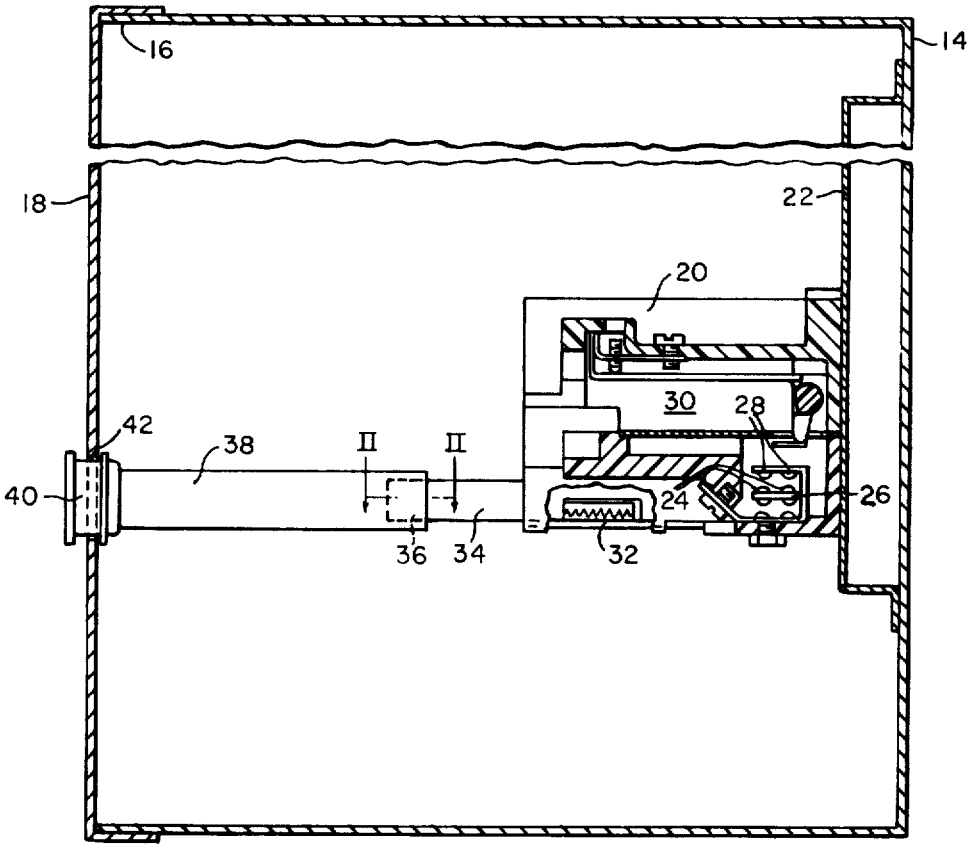
FIG. 1 is a vertical sectional view through a metal enclosure for a motor control center.

In FIG. 1 an electrical control device is generally indicated at 10, and it comprises an enclosure such as a metallic box-like structure 12 having a rear wall 14, a front opening 16, and an access door 18. The device 10 also comprises a relay or interrupter 20 which is mounted on a support base 22 which in turn is secured to the rear wall 14 in a suitable manner such as nut-and-bolt assembly (not shown). Inasmuch as the relay 20 is completely disclosed in U.S. Pat. No. 3,265,831, issued Aug. 9, 1966, to J. B. Ramsey et al., the description of the relay is limited to the parts that are essential to the operation of the invention disclosed herein.

The relay 20 comprises relatively movable contacts 24 mounted on a contact arm 26, stationary contacts 28, means 30 for actuating the contact between open and closed positions, as well as latch means generally indicated at 32 which is movable between unlatched and latched positions corresponding respectively to the open and closed positions of the contacts. Reset means are also provided for moving the latch means 32 to the latched position and comprises a reset rod 34. The reset rod 34 includes an end portion 36 which is spaced from the access door 18.

In accordance with this invention, an extension rod 38 extends between the reset rod 34 and the door 18. More particularly, the left end of the extension rod 38 is proximate to the inner end of a reset button 40 which is mounted in an aperture 42 in the door 18. Accordingly, the relay 20 may be reset merely by depressing the button 40 without the necessity of opening the access door 18.

Figure 2:
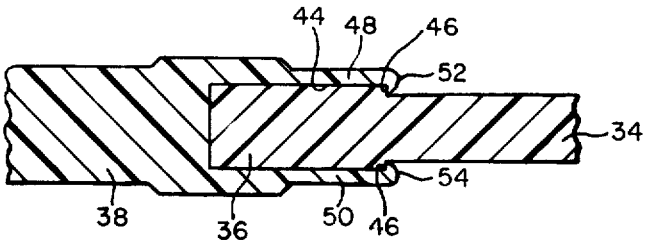
FIG. 2 is an enlarged fragmentary sectional view taken on the line II—II of FIG. 1.

As shown more particularly in FIG. 2, the extension rod 38 and the reset rod 34 are detachably assembled. The rods comprise releasable interengaging end portions including the end portion 36 and a hollow end portion 44 into which the end portion 36 is inserted. It is understood, however, that the end portion of the rods 34, 38 may be reversed so that the rod 38 may include an end portion similar to the end 36 and the rod 34 may be provided with the hollow end portion 44. Suffice it to say, the end portion 36 comprises a pair of similar outturned surfaces or shoulders 46. Correspondingly, hollow end portion 44 of the extension rod 38 comprises a number of flexible members 48, 50 which are oppositely disposed to contain the end portion 36. Each member 38, 50 also comprises inturned flanges 52, 54 which are jaw-like means for engaging the shoulders 46 (FIG. 2). In addition, to avoid lateral movement of the rods 34, 38 with respect to each other, each member 48, 50 comprises a lateral flange 56, 58 (FIG. 3) which engages opposite sides of the end portion 36 as shown in FIG. 4.

Both rods 34, 38 are comprised of electrically insulating material such as a resinous material, for example Zytel 101 nylon. In addition, the material comprising the extension rod 38 is preferably flexible so that the members 48, 50 are preset slightly inwardly and deflected outwardly when the end portion 36 is inserted therein. As shown in FIG. 3 the lateral flanges 56, 58 are slightly shorter than the members 48, 50 and terminate at ends 60, 62 without joining the body portion of the extension rod 38, thereby facilitating the flexible characteristic of the members 48, 50.

In another embodiment of the invention as shown in FIG. 5 a reset rod 64 and an extension rod 66 include flexible members 68, 70 for engaging the reset rod 64 with inturned flanges or jaws 72, 74 for engaging the shoulders 46. This embodiment of the invention differs from that of FIG. 3 in that the means for preventing lateral shifting of the rods 64, 66 with respect to each other comprises a pair of notches, one of which notches 77 is shown in FIG. 5, and a pair of projections 79 which are disposed in the notches 77 when the rods are assembled as shown in FIG. 6.

Figure 7:
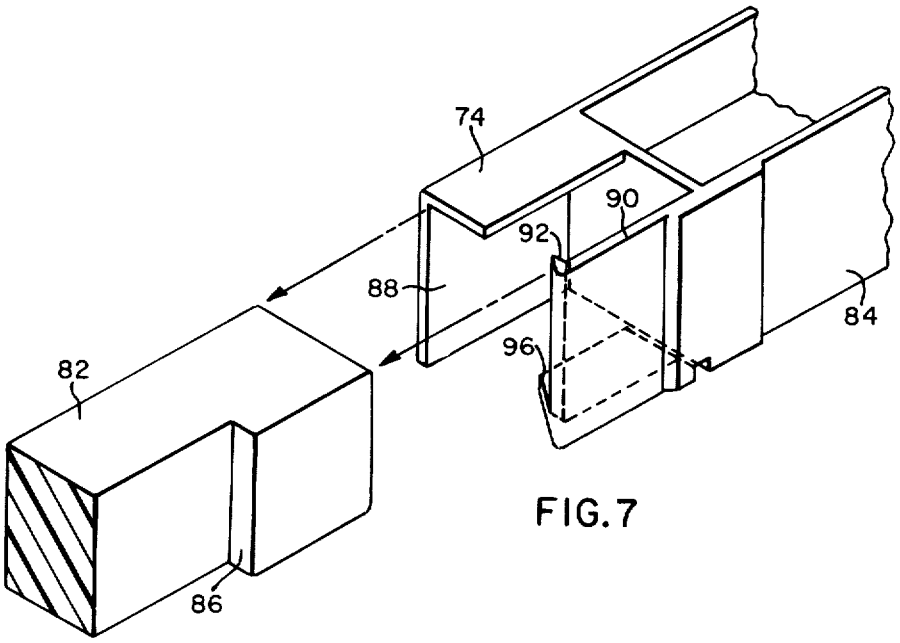

Another embodiment of the invention as shown in FIG. 7 comprises a reset rod 82 and an extension rod 84, the former of which includes one shoulder 86. The extension rod 84 includes one flexible member 90, one solid member 88, only the former or which includes an inturned flange 92 for engaging the shoulder 86. The embodiment of the invention shown in FIG. 7 may also be provided with lateral flanges 94, 96 for avoiding lateral shifting of the rods with respect to each other.

To facilitate assembly of the rods 34, 38 the flexible members 38, 50 include inwardly inclined opposing end surface 98, 100, respectively (FIG. 3). When the extension rod 38 is moved in the direction of the arrow 102 toward the end portion 36 of the reset rod 34, the inclined end surfaces 98, 100 spread the members 48, 50 outwardly as the end surfaces engage the opposite surfaces of the portion 36. Continued movement of the extension rod 38 in the same direction results in the flanges 52, 54 snapping into contact with the respective shoulders 46 when the end portion 36 is completely seated within the hollow end portion 44 of the extension rod 38 as shown in FIG. 2.

Figure 9:
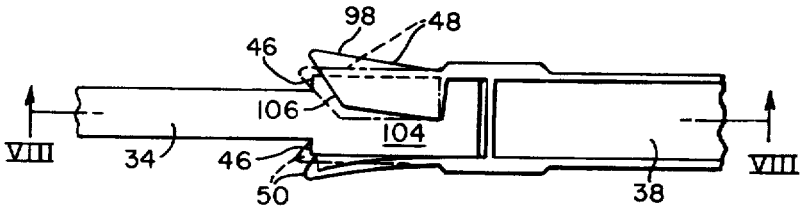
Figure 8:
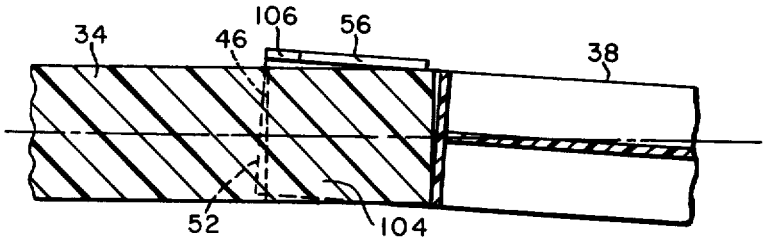
FIG. 8 is an enlarged fragmentary sectional view showing the manner of separation of the reset rod and extension rod taken on the line VIII—VIII of FIG. 9; and, FIG. 9 is a plan view of the assembled reset rod and extension rod showing the manner in which the clamping jaws are extended when the reset rod and extension rod are being separated.

The rods 34, 38 may be separated by rotating the rods in a manner shown in FIG. 8. Rotation of one rod 38 with respect to the other rod 34 so that the rod axes are no longer aligned, resulting in disassembly of the rods. For example, when the extension rod 38 is rotated with respect to the rod 34 against the lateral flanges 56, 58, one surface 104 of the reset rod 34 strikes a beveled edge 106 of one of the flanges 56, 58, such as the flange 56, causing the members 48 to flex outwardly until the clamping jaw or flange 52 is disengaged from the shoulder 46. The opposite flange 54 is likewise disengaged from the corresponding shoulder 46 (FIG. 9), whereupon defection of the members 48, 50 permits longitudinal separation of the rods 34, 38. The original position of the members 48, 50 and the original position of the shoulder 46 are shown in broken line position in FIG. 9. The alternate position for separation of the rods 34, 38 are shown in solid line positions for those members.

In conclusion, the extension rod 38 is provided with the members 48, 50 having clamping jaws or flanges 52, 54 which in the assembled position of the rods grip the head or end potion of the reset rods to hold the rods firmly in place to prevent longitudinal movement. The lateral flanges 56, 58 also prevent lateral shifting of the extension rod from the reset rod and thereby retain the extension rod and reset rod in alignment at all times. Finally, if for any reason it is desirable to separate the rods, the extension rod 38 is twisted out of alignment with the reset rod 34 whereby the surfaces of the reset rod engage one of the beveled edges 106, 108, depending upon the direction of rotation of the extension rod, until one of the jaws or flanges 52, 54 is disengaged from the corresponding shoulder surface 46 of the reset rod 34.

What is claimed is:

1. An electric control device comprising an enclosure including a rear wall, a front opening, and an access door for the front opening and having an aperture therein; a circuit interrupter mounted in the enclosure on the rear wall and spaced from the access door, the interrupter comprising relatively movable contacts, means for activating the contacts between open and closed positions and comprising a latch member movable between unlatched and latched positions corresponding respectively to the open and closed positions of the contacts, reset means for moving the latch member to the latched position and comprising a reset rod having an end portion spaced from the access door, an extension rod between said end portion and the access door, and the extension rod comprising one end detachably mounted on the reset rod and having another end located at the door aperture.

2. The device of claim 1 in which the reset rod and the extension rod comprise releasable interengaging end portions.

3. The device of claim 2 in which one of the rods comprises an inserted end portion and the other rod comprises a hollow end portion shaped to receive said inserted end portion and including flexible members for grasping the inserted end portion.

4. The device of claim 3 in which the flexible members comprise a pair of opposed elements disposed on opposite sides of the inserted end portion, each element having an engaging surface, and the inserted end portion having engaged surface means for interengagement with the engaging surfaces.

5. The device of claim 4 in which the inserted end portion comprises at least one shoulder surface, and the flexible members comprise jaw means of engagement with the shoulder surface.

6. The device of claim 5 in which the inserted end portion and flexible members comprise cooperating means for avoiding lateral movement thereof.

7. The device of claim 6 in which the flexible members and inserted end portion comprise cooperating surfaces extending laterally of the shoulder surface.

8. the device of claim 6 in which one of the flexible members and inserted end portion comprise a projection and the other of the members and inserted end portion comprise projection-receiving means.

9. The device of claim 7 in which the inserted end portion is multisided and each flexible member comprisesa flange engaging a side adjacent another side engaged by the flexible member.

10. The device of claim 9 in which at least one flange comprises an inclined end surface to effect disengagement of the flexible members from the inserted end portion when the extension rod is rotated with respect to the reset rod to cause the end portion to move along the inclined end surface and thereby spread the flexible members.

11. The device of claim 10 in which each flexible member comprises a beveled end surface to effect separation of the members when the inserted end portion of the reset rod is moved between the flexible members.

* * * * *